US006595177B1

(12) United States Patent
Kramar

(10) Patent No.: US 6,595,177 B1
(45) Date of Patent: Jul. 22, 2003

(54) ROTARY SLEEVE PORT FOR AN INTERNAL COMBUSTION ENGINE

(75) Inventor: Paul Kramar, Orange, CA (US)

(73) Assignee: Kramer Jewelers, Inc. #2, Orange, CA (US)

( * ) Notice: Subject to any disclaimer, the term of this patent is extended or adjusted under 35 U.S.C. 154(b) by 0 days.

(21) Appl. No.: 10/086,161

(22) Filed: Feb. 27, 2002

(51) Int. Cl.[7] ..... F01L 7/02
(52) U.S. Cl. ..... 123/190.2
(58) Field of Search ..... 123/190.2, 190.8, 123/190.1, 190.12, 190.4, 80 BA, 80 R, 80 BB, 80 C, 80 D

(56) References Cited

U.S. PATENT DOCUMENTS

| | | | | |
|---|---|---|---|---|
| 1,097,166 | A | | 5/1914 | Calkins et al. |
| 1,171,834 | A | | 2/1916 | Brower |
| 1,213,873 | A | | 1/1917 | Hollmann |
| 1,252,753 | A | | 1/1918 | Wehr |
| 1,299,265 | A | | 4/1919 | Thayer |
| 1,360,107 | A | | 11/1920 | Fronk |
| 1,386,477 | A | | 8/1921 | Wallace |
| 1,578,581 | A | | 3/1926 | Casna |
| 1,677,460 | A | | 7/1928 | Pope, Jr. |
| 1,702,816 | A | | 2/1929 | Danford |
| 1,740,758 | A | | 12/1929 | White |
| 1,890,326 | A | | 12/1932 | Hansen |
| 1,967,734 | A | | 7/1934 | Baker |
| 2,169,631 | A | | 8/1939 | Cross |
| 2,183,024 | A | | 12/1939 | Large |
| 3,171,425 | A | | 3/1965 | Berlyn |
| 3,547,094 | A | | 12/1970 | Yasuda |
| 3,948,227 | A | | 4/1976 | Guenther |
| 4,506,636 | A | | 3/1985 | Negre et al. |
| 4,546,743 | A | | 10/1985 | Eickmann |
| 4,556,023 | A | | 12/1985 | Giocastro et al. |
| 4,572,116 | A | | 2/1986 | Hedelin |
| D289,915 | S | | 5/1987 | Ferrer Beltran |
| 4,739,737 | A | | 4/1988 | Kruger |
| 4,782,656 | A | | 11/1988 | Hansen |
| 5,205,251 | A | * | 4/1993 | Conklin ..... 123/190.12 |
| 5,309,876 | A | | 5/1994 | Schiattino |
| 5,410,996 | A | | 5/1995 | Baird |
| 5,579,730 | A | | 12/1996 | Trotter |
| 5,711,265 | A | | 1/1998 | Duve |

* cited by examiner

*Primary Examiner*—Henry C. Yuen
*Assistant Examiner*—Hyder Ali
(74) *Attorney, Agent, or Firm*—Gene Scott-Patent Law & Venture Group

(57) ABSTRACT

A porting apparatus in an internal combustion engine delivers and exhausts gas in a combustion space. A pair of cylinders each have a cylinder wall mounted for rotation within a head of an engine block. The cylinders each provide a pair of apertures in diametrically opposing and axially offset positions through the wall of the cylinder. A pair of rotatable manifold rods, each axially oriented, are each positioned within one of the cylinders. The manifold rods each provide a through port adapted for alignment with the pair of apertures of a corresponding one of the cylinders, such that within each of the cylinders and corresponding through ports, a gas flow is enabled for communication from one of the pair of apertures to the other of the pair of apertures through the through port upon each full rotation of the cylinders which are driven in coordination with the engine.

3 Claims, 2 Drawing Sheets

ROTARY SLEEVE PORT FOR AN INTERNAL COMBUSTION ENGINE

BACKGROUND OF THE INVENTION

1. Field of the Invention

This invention relates generally to the porting of gases in and out of an internal combustion engine, and more particularly to a rotary valve system enabled for efficient gas flow, throttling of gas flow, improved mixing of gas flow and timing of gas flow.

2. Description of Related Art

The following art defines the present state of this field:

Ferrer Beltran, U.S. Des. 289,915 describes a rotary valve shaft design.

Calkins et al., U.S. Pat. No. 1,097,166 describes the combination of the cylinder and the rotating cylindrical valve at the outer end thereof, of a sectional bearing chamber for the valve, one of the sections of the chamber being connected to the cylinder, and the other section being movable toward and from the first-named section, means in connection with the engine for transmitting the pressure from the combustion chamber of the cylinder to the movable bearing section to cause the pressure exerted by the said section on the valve to vary with the variations of pressure in the combustion chamber, springs normally pressing the movable section toward the fixed section, means for varying the, tension the valve and the bearing chamber, the said lining consisting of similar semi-cylindrical sections, each section having a radial dowel pin, one of the sections of the lining being arranged adjacent to each section of the bearing chamber, each of the said bearing chamber sections having an opening for receiving the dowel pin to fix the lining with respect to the bearing chamber section.

Brower, U.S. Pat. No. 1,171,834 describes the combination with a plurality of engine cylinders provided each with an intake port in the head thereof, of a relatively fixed supply tube extending through the heads of all the cylinders and provided with inlet ports registering with the intake ports of the individual cylinders, fuel supply connection to the opposite ends of the said supply tube, a rotary valve concentrically disposed with respect to the supply tube provided with valve ports therein to register with the inlet ports in the supply tube and the intake ports in the cylinders, and means for rotating the said valve in time with the functions of the different cylinders of the engine.

Hollmann, U.S. Pat. No. 1,213,873 describes a rotary sleeve valve having internal and external bearing surfaces and ports for the passage of gas, and having in its external face circumferential recesses made therein at points coincident with the ports respectively.

Wehr, U.S. Pat. No. 1,252,753 describes the combination with a valve-casing, of a rotary valve arranged therein, a lining for aid casing shiftably arranged in the latter and ahving a concave portion forming the seat for said valve and completely surrounding the latter, and means engaging said lining and said casing for causing a continuous contact between said seat and said valve.

Thayer, U.S. Pat. No. 1,299,264 describes the combination with the cylinder of an internal-combustion engine, of a valve-casing having a port communicating with said cylinder, a plurality of concentric rotary valve-members located in said casing and provided with diametric ports adapted to register with each other and with said casing-port, and means intermittently moving said valve-members in the same direction but at different speeds respectively.

Fronk U.S. Pat. No. 1,360,107 describes a rotary valve mechanism for internal combustion engines, comprising a poart closing an end of the cylinder and provided with three ports, one in communication with the cylinder, the second constituting the exhaust port and the port Opening into the cylinder being in the same plane and disposed quartering and the intake port being in a different relative plane, and a rotary valve mounted in said part and having three ports in communication at their inner ends, two of the ports being in the same plane and set quartering and adapted to register with the exhaust port and the port opening into the cylinder formed in the part in which the valve is mounted and the third port being in a different relative plane and diametrically opposite on of the said two ports and adapted to register with the intake port only during each complete revolution of the valve.

Wallace, U.S. Pat. No. 1,386,477 describes the combination with an engine cylinder, of a valve mechanism comprising a casing with a curved seat and connected with the engine cylinder by a port, a pair of curved valves concentrically arranged in the said casing, the valves having oprts, means for moving the valves to cause their ports to register with teach other and with the port leading to the engine cylinder with a frequency required by the cycle on which the engine operates, and an adjustable curved valve mounted between the said movable valves and arranged to vary the effective size of the opening to the engine cylinder the latter valve being normally stationary and means for adjusting the said normally stationary valve.

Casna, U.S. Pat. No. 1,578,581 describes the combination with a cylinder having a piston therein and also having an inlet port, of a rotary tubular valve controlling said port, a tubular control member within said valve, a shaft extending axially of the valve and having a radial arm, a throttle member carried by said arm and engaging the inner wall of the control member, said control member being turnable about its axis and co-operating with the throttle member to vary the time of cut off.

Pope, Jr., U.S. Pat. No. 1,677,460 describes the combination of a cylinder having a combustion chamber, a rotary valve having a combustion chamber, a rotary valve having a port adapted to communicate with said combustion chamber during the intake and exhaust strokes of the engine, and a uniplanar sealing ring engaging said valve, the plane of said ring being at an angle with the cylinder axis and the ring being positioned to pass entirely below the valve port and to seal the valve port from the combustion chamber during the compression and firing strokes.

Danford, U.S. Pat. No. 1,702,816 describes a valve for use in multi-cylinder engines, a valve casing formed with an outlet opening leading to each cylinder and formed with a plurality of inlet openings, each inlet opening serving two outlet openings, and a valve mounted for rotation in the casing and formed with a pair of ports therethrough in each of two right angled diametric positions of the valve, the ports of each pair being in parallelism and inclined to the longitudinal and transverse axis of the valve, the respective ports of a pair cooperating with different inlets and different outlets of the valve casing at intervals indicated by a half revolution of the valve, the valves of one pair being arranged between the valves of the other pair and at directly opposite inclination to the valves of such other pair, each pair of ports opening through the surface of the valve in direct longitudinal alignment axially of the valve.

White, U.S. Pat. No. 1,740,758 describes a valve means for internal combustion engines comprising a valve chamber, a sleeve within said chamber but disposed with slight clearance therefrom, a stationary core member disposed with slight clearance within said sleeve, said sleeve and said core having staggered inlet and exhaust ports, packing rings arranged on said core member between adjacent inlet and exhaust ports, and trunnion means for supporting said sleeve independently of said core and said chamber.

Hansen, U.S. Pat. No. 1,890,326 describes the combination of a piston chamber, separate intake and exhaust valves therefor, each of said valves comprising a cylindrical casing having diametrically disposed port openings therethrough and communicating with said chamber, and comprising also a rotatable, hollow cylindrical valve member within said casing and having diametrically disposed openings there through for registry with said port openings, means of communication between the inside of each of said valve members and the outside of said casing for intake and exhaust, and means for rotating said valve members in properly timed sequence, said valves being so constructed and operated that the impact of the explosions individually upon the valves will be counter-balanced upon diametrically opposite sides of each of said valves.

Baker, U.S. Pat. No. 1,967,734 describes a rotary valve element having one or more ports, a ported casing surrounding said valve element, a cam rotatable with said valve element, a cam follower mounted in said casing for radial movement toward and away from the valve element, and yielding means for forcing said cam follower toward engagement with said cam.

Cross, U.S. Pat. No. 2,169,631 describes a cylindrical valve surmounting said cylinder, a housing for said valve divided into inner and outer floating parts, the inner floating part being movable toward the valve under the action of pressure developed in the cylinder, and a lever system through which said movement of the inner floating part causes the outer floating part to press on the valve with a force which is a controlled fraction of the force applied to the inner floating part by the gas pressure.

Large, U.S. Pat. No. 2,183,024 describes a rotary valve structure for engines, comprising a unitary engine head having thereon at least a pair of spaced valve housings and a bearing housing disposed intermediate of and spaced from said valve housings, said housings having aligned ports therein, a rotor passing through and jounaled in said bearing and valve housings, valving means in said rotor and positioned within said valve housings for controlling the flow of a fluid under pressure through the valve housings, means to supply oil under pressure to aid bearing housing, and the spaces between the spaced valve and bearing housings being maintained at a constant pressure differing from the pressure of the fluid passing through said valve housings and the pressure of the oil in said bearing housing.

Berlyn, U.S. Pat. No. 3,171,425 describes a housing having a valve bore with port means adapted to communicate therewith, a cylindrical rotary valve mounted in a free fit for continuous rotary motion in said valve bore, means for reciprocating said valve axially upon its rotation, a lattice of seals on the periphery of said rotary valve, said lattice of seals comprising at least four circumferential and four longitudinal sealing elements, said valve having a diametral valving duct and at least two pairs of pressure balancing ducts connecting diarnetrally opposed zones of equal area as defined by said lattice of seals, internal cooling means within said rotary valve, and means for applying lubricant to the periphery of said rotary valve outside the perimeter of said lattice.

Yasuda, U.S. Pat. No. 3,547,094 describes a rotary-valve engine in which there are provided rotary bodies each of a circular shape in section and a notch on one part thereof, the rotary bodies are each disposed in opposite to the intake and exhaust ports of the cylinder of the engine, and the rotary bodies make rotation thereby alternately opening and closing the intake and exhaust ports at desired time intervals.

Guenther, U.S. Pat. No. 3,948,227 describes an apparatus for applying a stratified charge to a reciprocating internal combustion engine. The apparatus comprises a cylindrical rotary valve body disposed for rotation within the head of an internal combustion engine. The valve body defines diametrically extending inlet and exhaust passages which, during rotation of the valve body, place a cylinder of the engine in sequential communication with an inlet manifold and an exhaust manifold secured to the head. The inlet manifold comprises a double-passage gallery and a rich fuel air charge in a second passage. Rotation of the inlet passage into communication with the cylinder also brings the inlet passage into sequential communication with the first throat and then the second throat for transporting the first lean charge and then the second rich charge to the cylinder. Means are also provided for shielding the exhaust passages from excessive exhaust head; for sealing the rotary valve body and for controlling the timing of the valve in response to engine demand.

Negre et al., U.S. Pat. No. 4,506,636 describes a device for controlling the evacuation of exhaust gases of a combustion chamber in an internal combustion engine. A rotary valve performs a continuous or alternate turning movement and synchronized with the rotation of the motor about an axis parallel to the axis of rotation of the motor and issues at the level of its transversal channel on one side on an orifice connected to the exhaust towards the outside. The invention is applied to the control of the exhaust of two stroke engines.

Eickmann, U.S. Pat. No. 4,546,743 describes a rotary valve with an axially extending passage revolving in a bed of a valve bearing body which has inlet passage means and a fluid transfer channel. The valve controls the periodic flow of fluid from the inlet means to the transfer channel. Fluid pressure containing pockets are provided diametrically of the transfer channel to let the rotary valve member float between opposed pressure fields. Accessory means can be provided to the rotary valve to secure equal forces at equal times on diametrically opposed portions of the outer face of the rotary valve member.

Giocastro et al., U.S. Pat. No. 4,556,023 describes a pair of rotary valves for an internal combustion engine positioned in a cylinder head over a cylinder block. The rotary valves include a pair of rotatable shafts, and a pair of sleeve supports having ports opening to the cylinder or cylinders of the engine. The pair of rotatable shafts can be either hollow or solid. The hollow intake shaft brings in a fuel mixture to an inlet passage that rotates into alignment with an intake opening in the intake shaft to the piston cylinder. The hollow exhaust shaft allows exhaust of burned gases from the piston chamber through an exhaust opening from the piston cylinder to an exhaust passage in the exhaust shaft and to the atmosphere. The solid rotatable shafts are provided with a diametrical intake channel and a diametrical exhaust channel that aligns with the openings to the piston cylinder and to the fuel mixture and to the atmosphere. Drive and timing gearing between the crankshaft and the intake and exhaust shafts are provided.

Hedelin, U.S. Pat. No. 4,572,116 describes an internal combustion engine having at least one chamber where there is a moving working member, an inlet valve and an outlet valve as well as a compression regulation device. In an inlet channel there is arranged a regulating valve upstream of the inlet valve, said regulating valve being open only during a portion of the motion cycle of the working member. This regulating valve has a rotatable valve body provided with at least one inlet passage, the rotational speed of the body being proportional to that of the engine.

Krugger, U.S. Pat. No. 4,739,737 describes that in order to produce a rotary valve with short and small cross-sectional dimensions, fresh gas or exhaust gas ducts of the rotary valve are associated with adjacent cylinders and extend in some regions in a common cross-sectional plane, in different halves of the cross section of the rotary valve outside the longitudinal axis thereof, the plane also contains two diametrically opposite fresh gas and, respectively, exhaust gas openings in the rotary valve housing.

Hansen, U.S. Pat. No. 4,782,656 describes a rotary internal combustion engine having a housing with an elliptical inside surface surrounding an elliptical rotor forming with the housing combustion chambers. Valve and ignition assemblies connected to a source of air under pressure and injectors for introducing fuel into the air supply sequentially allows the air and fuel mixture to flow into the combustion chambers and ignite the air and fuel mixture therein. Vane and seal assemblies on the rotor and housing are controlled with cam and linkages to provide positive effective gas seals between the housing and rotor. A slack adjuster maintains lateral sealing relationships between the housing vane and seal assemblies and opposite side walls of the housing.

Schiattino, U.S. Pat. No. 5,309,876 describes an automatic variator for use in an internal combustion engine and other engines which use valve-type distribution systems, to operate a twin set of double-effect distribution sequential valve shafts for the purpose of regulating the valve overlap and the valve opening section while the engine is running. A motor reducer advances a spindle against the valve shaft with a grooved screw at one end of same, causing the shaft to turn and move, thereby varying the valve overlap and the valve section.

Baird, U.S. Pat. No. 5,410,996 describes an improved rotary valve assembly that is rotated by chain, belt or gears that are driven by a reciprocating engine which has intake and exhaust rotary valves that have ports and interior channels that are sequentially positioned to allow the intake and exhaust of gases and alternatively seals the combustion chamber. The rotary valve ports and intake and exhaust ports may be varied axially and circumferential to change the engine time and gas volume capacity of the engine.

Trotter, U.S. Pat. No. 5,579,730 describes a rotary valve head assembly including a split head assembly, a rotary spool assembly,spool drive assemblies, and bearing and spool lubrication components. The split head assembly has bores for containing the spool assembly, bearings and spool seals, and defines passages for coolant and lubricant to pass therethrough. The head assembly is separable to provide unencumbered access to the components contained therein. The spool assembly is cylindrical and extends the length of the head assembly. The spool assembly has two ports for each combustion chamber. Each port is provided with a port relief to control the duration it is open. A separate and independent spool drive assembly provides each spool assembly rotating action. Each drive assembly effectively changes the timing of a corresponding spool assembly via instructions from the engine management system, allowing intake and exhaust timing can be controlled independently. The drive system simultaneously allows the engine to function as a compressor, thus providing an engine brake. The bearing and spool lubrication components provide support and lubrication for the spool assembly. Spring loaded lubricant control seals are mounted in the bearings and maintain contact with the spool assembly. The seals are also provided with a chamfer to control oil consumption while maintaining effective combustion chamber sealing. The instant invention eliminates the need for intake and exhaust valves and related actuation hardware, such as cams, lifters, rocker arms, and pushrods.

Duve, U.S. Pat. No. 5,711,265 describes an improved drive mechanism for rotary valves of the type used in internal combustion engines indexing the valves in selected attitudes of rotation to align the valve passage with an inlet or exhaust port and holding the valve in alignment for a selectable duration of crankshaft rotation. In like fashion, the valves are also indexed to close off an inlet or exhaust port for a selected duration of crankshaft rotation. Flow into and out of an engine cylinder is improved because each valve is held for a longer period of time in a full open position while compression and power strokes are made more efficient by the gas seal maintained while the valves are positioned to close off the intake and exhaust ports.

The prior art teaches the use of rotating through ports for providing flow of a gas into an internal combustion engine but does not teach such using a fixed port and a rotating sleeve so as to improve gas flow dynamics. The present invention fulfills these needs and provides further related advantages as described in the following summary.

SUMMARY OF THE INVENTION

The present invention teaches certain benefits in construction and use which give rise to the objectives described below.

A porting apparatus in an internal combustion engine delivers and exhausts gas in a combustion space. A pair of valving cylinders each have a cylinder wall mounted for rotation within a head of an engine block. The cylinders each provide a pair of apertures in diametrically opposing and axially offset positions through the wall of the cylinder. A pair of rotatable manifold rods, each axially oriented, are each positioned within one of the valving cylinders. The manifold rods each provide a through port adapted for alignment with the pair of apertures of a corresponding one of the cylinders, such that within each of the cylinders and corresponding through ports, a gas flow is enabled for communication from one of the pair of apertures to the other of the pair of apertures through the port upon each full rotation of the valving cylinders which are driven in coordination with the engine. One advantage of the present invention is that a manifold vane and mixing baffles may be placed in the through port to adjust gas flow as necessary to optimize gas dynamics. A further advantage is that the valving cylinders may be adapted to rotate at one-half the rate of the engine instead of at one-forth so that reduction gears may be significantly reduced in size. A further advantage is that the inlet channel (through port) directs gas flow at an angle into the combustion chamber thereby causing improved mixing.

A primary objective of the present invention is to provide an apparatus and method of use of such apparatus that provides advantages not taught by the prior art.

Another objective is to provide such an invention capable of controlling gas flow into and out of an internal combustion engine.

A further objective is to provide such an invention capable of throttling the gas flow into and out of an internal combustion engine.

A still further objective is to provide such an invention capable of adjusting gas flow timing to an internal combustion engine.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
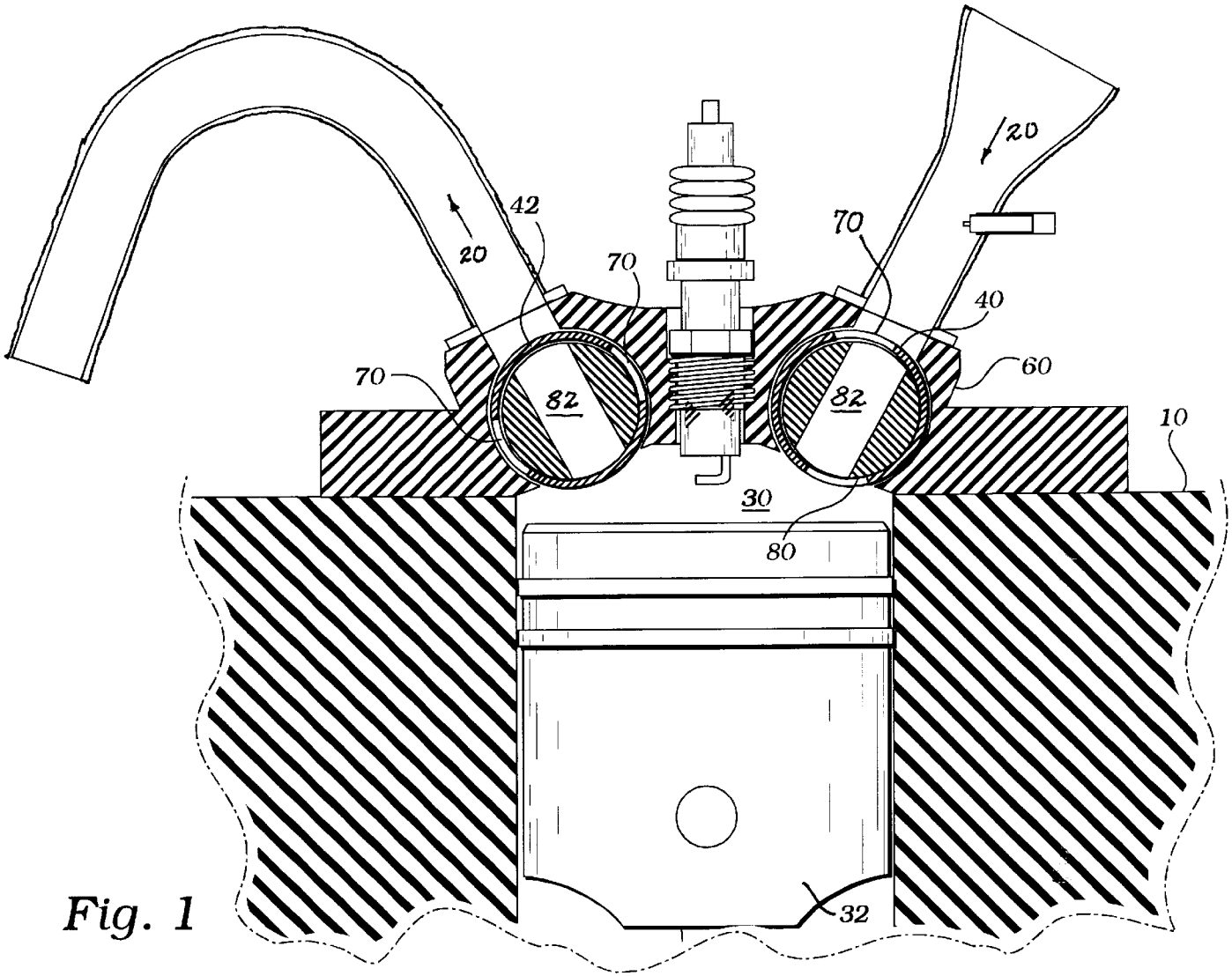
FIG. 1 is a conceptional end sectional view of the preferred embodiment of the invention.
Figure 2:
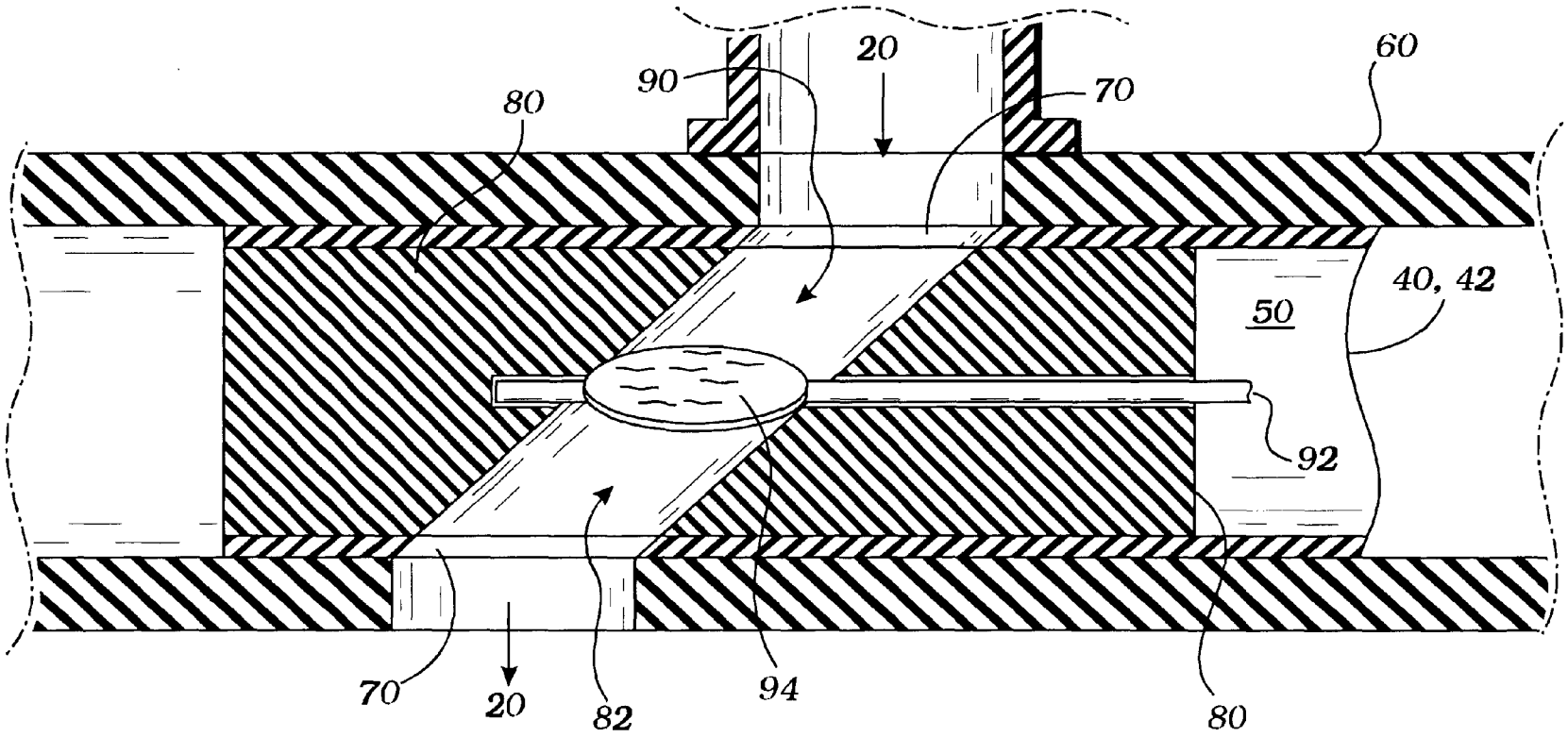
FIG. 2 is a conceptional side sectional view thereof.

The present invention is a porting apparatus in an internal combustion engine 10 for delivering a gas 20 to a combustion space 30 and for exhausting the gas 20 upon completion of combustion within the combustion space 30. The apparatus comprises a pair of rotating valving cylinders 40, 42 for each combustion space 30, typically an engine cylinder-piston arrangement as is well known and shown in FIG. 1. Each of the valving cylinders 40, 42 has a cylindrical wall 50 which is mounted for rotation, preferably on bearing sets (not shown) within the engine head 60 and is rotated by a belt (not shown) driven by the engine crankshaft (not shown). The actual arrangement of mounting the valving cylinders 40, 42 on bearings and attachment to an engine crankshaft is considered routine and not therefore of particular interest as to details here. However, H. W. Thayer and D. A. Duve, U.S. teach the use of drive belts and similar arrangements in U.S. Pat. No. 1,299,264 and 5,711,265 which are hereby incorporated by reference into this application in order to teach this method which is old technique and wholly applicable to the present invention. In this manner, the valving cylinders 40, 42 are rotationally coordinated with engine piston 32 movement and are thus adapted for admitting an air-fuel mixture as a gas 20 into, the engine's combustion space 30 at the right moment, and for allowing spent gases to be exhausted as well, on appropriate cycles of the engine 10. Each of the valving cylinders 40, 42 provides a pair of apertures 70 in diametrically opposing and axially offset positions through the wall 50 of the valving cylinder, as is best seen in FIG. 2. A rotatable manifold rod 80 is axially oriented within each of the valving cylinders 40, 42 and provides an off-angle through port 82 adapted by its position within the manifold rod 80, for alignment with the pair of apertures 70 of its corresponding valving cylinder 40 or 42, such that the valving cylinders 40, 42 and corresponding through ports 82 are enabled for gas flow communication from one of the pair of apertures 70 to the other of the pair of apertures 70 through the port 82 upon each full rotation of the valving cylinders 40, 42. If the port 82 were normal to the axis of rotation, gas would be admitted twice per rotation. Thus, the gear ratio of the engine's crankshaft and the valving cylinders 40, 42 is 2:1 an advantage in smaller size of gears.

In an alternate embodiment, a vane assembly 90 comprises a vane 94 positioned on a rotating shaft 92 within each of the through ports 82, where each vane 94 is adapted by its mounting, as shown in FIG. 2, for rotational throttling of the gas flow. The vane 94 consists of a flat plate attached to the shaft 92 so that it may be oriented in a position where the flat plate effectively closes-off the port 82, or alternately, in a rotational position where the flat plate presents only its peripheral edge to gas flow so as to present the least possible impendence. Such vanes 94 are well known in the field of gas flow dynamics. In the present invention, the through port 82 is partially closed by the vane 94 at low engine RPM in order to keep gas flow rate high. Also, the clock position of the through port 82 may be changed slightly to effect intake and exhaust timing to provide maximum power at both low and high engine RPM. The clock position of the manifold rod 80 is easily changed by servo-controlled rotation as would be easily implemented by one of skill in the art. This, in turn, changes the timing of gas inlet and exhaust.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A porting method in an internal combustion engine for delivering a gas mixture to a combustion space and for exhausting said gas mixture upon completion of combustion, comprising the steps of: mounting at least one valving cylinder within a head of an engine block and for each one of the at least one valving cylinder, providing the valving cylinder with a pair of apertures in diametrically opposing and axially offset positions through a wall of the cylinder, axially positioning a ranifold rod within the valving cylinder, providing a through port in the manifold rod in alignment with the pair of apertures such that a gas flow may communicate from one of the pair of apertures to the other of the pair of apertures through the through port; rotating the valving cylinder in timing with the internal combustion engine for porting the engine; and positioning the manifold rod such that the through port is aligned with the pair of apertures once per each full rotation of the valving cylinder.

2. The method of claim 1 further comprising the step of positioning a vane within the through port; and adapting the vane for rotational throttling of said gas mixture flow within the through port.

3. The apparatus of claim 1 further comprising the step of rotationally positioning the manifold rod for adjustment of timing of gas mixture flow within the through port.

* * * * *

UNITED STATES PATENT AND TRADEMARK OFFICE

CERTIFICATE OF CORRECTION

PATENT NO. : 6,595,177 B1
DATED : July 22, 2003
INVENTOR(S) : Paul E. Kramar

It is certified that error appears in the above-identified patent and that said Letters Patent is hereby corrected as shown below:

Title page,
Item [73], Assignee, replace "Kramer Jewelers, Inc. #2" with -- Kramar Jewelers, Inc. #2 --.

Column 8,
Line 43, replace "cylinder, axially positioning a ranifold…" with -- cylinder, axially positioning a manifold… --.

Signed and Sealed this

Twenty-fifth Day of November, 2003

JAMES E. ROGAN
*Director of the United States Patent and Trademark Office*